US008794855B2

(12) United States Patent
Usui

(10) Patent No.: US 8,794,855 B2
(45) Date of Patent: Aug. 5, 2014

(54) IMAGE FORMING APPARATUS, METHOD FOR DETERMINING COMPATIBILITY OF SHEET FEEDER, AND NON-TRANSITORY COMPUTER-READABLE MEDIUM

(75) Inventor: Hidekazu Usui, Kanagawa (JP)

(73) Assignee: Fuji Xerox Co., Ltd., Tokyo (JP)

( * ) Notice: Subject to any disclaimer, the term of this patent is extended or adjusted under 35 U.S.C. 154(b) by 775 days.

(21) Appl. No.: 12/883,679

(22) Filed: Sep. 16, 2010

(65) Prior Publication Data

US 2011/0217107 A1 Sep. 8, 2011

(30) Foreign Application Priority Data

Mar. 3, 2010 (JP) ..... 2010-046706

(51) Int. Cl.
*B41J 11/00* (2006.01)
*B41J 11/44* (2006.01)

(52) U.S. Cl.
CPC ..... *B41J 11/44* (2013.01)
USPC ..... 400/582; 400/624

(58) Field of Classification Search
CPC ..... B41J 11/44
USPC ..... 400/582
See application file for complete search history.

(56) References Cited

U.S. PATENT DOCUMENTS 4,663,722 A * 5/1987 Sato ..... 700/213
5,220,352 A * 6/1993 Yamamoto et al. ..... 347/214
5,446,524 A * 8/1995 Koike ..... 399/45
5,740,028 A * 4/1998 Sugiyama et al. ..... 725/149
6,249,835 B1 * 6/2001 Isoda ..... 710/100
6,775,020 B2 * 8/2004 Fukunaga et al. ..... 358/1.15
6,978,114 B2 * 12/2005 Okamoto et al. ..... 399/389
7,377,506 B2 * 5/2008 Miyajima ..... 271/9.03
7,936,381 B2 * 5/2011 Mori et al. ..... 348/231.6
8,368,940 B2 * 2/2013 Toda ..... 358/1.18
2008/0240887 A1 * 10/2008 Gotoh et al. ..... 412/4

FOREIGN PATENT DOCUMENTS

JP 06-115802 A 4/1994
JP 06-305599 A 11/1994
JP 2002-67442 A 3/2002

OTHER PUBLICATIONS

Communication from the Japanese Patent Office dated Oct. 4, 2013, in a counterpart Japanese application No. 2010-046706.

* cited by examiner

*Primary Examiner* — Anthony Nguyen
(74) *Attorney, Agent, or Firm* — Sughrue Mion, PLLC

(57) ABSTRACT

An image forming apparatus includes a sheet feeder attaching unit, a communication unit, a connection determining unit, an acquiring unit, a storage unit, a compatibility determining unit and a forcible unconnected control unit. The connection determining unit causes the communication unit to communicate with a communication section of a sheet feeder, and determines whether the sheet feeder is connected based on a communication result. The acquiring unit acquires attribute information of the sheet feeder. The storage unit stores attribute information of sheet feeders being compatible, in terms of control, with the image forming apparatus. The compatibility determining unit determines whether the connected sheet feeder is compatible by comparing the acquired attribute information of the connected sheet feeder with the stored attribute information. The forcible unconnected control unit establishes a forcible unconnected state between the connected sheet feeder and the image forming apparatus if the compatibility determining unit determines not-compatible.

1 Claim, 12 Drawing Sheets

FIG. 5

1633

| COMPATIBILITY SETTING INFORMATION | | | | |
|---|---|---|---|---|
| APPARATUS MAIN BODY (UNIQUE ID) / OPTIONAL UNIT (ROM VERSION) | APPARATUS MAIN BODY A (1000) | APPARATUS MAIN BODY B (2000) | APPARATUS MAIN BODY C (3000) | ... |
| SHEET FEEDER A (01.**.**) | 1 (COMPATIBLE) | 1 | 1 | ... |
| SHEET FEEDER B (02.**.**) | 0 (INCOMPATIBLE) | 1 | 1 | ... |
| SHEET FEEDER C (03.**.**) | 0 | 0 | 1 | ... |
| ⋮ | ⋮ | ⋮ | ⋮ | ⋮ |

FIG. 7A

1634

| CONNECTION MANAGEMENT TABLE | |
|---|---|
| ATTACHMENT POSITION | CONNECTION STATUS 1: CONNECTED, 0: NOT CONNECTED |
| TRAY 1 | 1 |
| TRAY 2 (OPTION 1) | 1 |
| TRAY 3 (OPTION 2) | 0 |
| ⋮ | ⋮ |

FIG. 7B

1635

| COMPATIBILITY MANAGEMENT TABLE | |
|---|---|
| ATTACHMENT POSITION | COMPATIBILITY 1: COMPATIBLE, 0: INCOMPATIBLE |
| TRAY 1 | |
| TRAY 2 (OPTION 1) | 1 |
| TRAY 3 (OPTION 2) | 0 |
| ⋮ | ⋮ |

IMAGE FORMING APPARATUS, METHOD FOR DETERMINING COMPATIBILITY OF SHEET FEEDER, AND NON-TRANSITORY COMPUTER-READABLE MEDIUM

CROSS-REFERENCE TO RELATED APPLICATIONS

This application is based on and claims priority under 35 USC 119 from Japanese Patent Application No. 2010-46706 filed on Mar. 3, 2010.

BACKGROUND

1. Technical Field

The invention relates to an image forming apparatus, a method for determining compatibility of a sheet feeder, and a non-transitory computer-readable medium storing a program that causes a computer to execute a process for determining compatibility of a sheet feeder.

2. Related Art

Image forming apparatuses such as multifunction machines are known to which an optional sheet feeder (sheet feed tray), in addition to a standard one, can be attached.

In an image forming apparatus to which an optional sheet feeder can be attached, there is a probability that an optional sheet feeder can be connected to the apparatus main body in a physical sense because the image forming apparatus has compatibility with the optional sheet feeder but its unstable connection state causes an erroneous operation. To check compatibility of an optional sheet feeder connected to the apparatus main body, it is necessary to determine as to whether or not the connected optional sheet feeder is one for another type of apparatus main body.

SUMMARY

According to one aspect of the invention, an image forming apparatus includes a sheet feeder attaching unit, a communication unit, a connection determining unit, an acquiring unit, a storage unit, a compatibility determining unit and a forcible unconnected control unit. The connection determining unit attempts to cause the communication unit to communicate with a communication section of a sheet feeder, and determines as to whether or not the sheet feeder is connected to the sheet feeder attaching unit based on a result of the communication. The acquiring unit acquires attribute information of the sheet feeder by communicating with the communication section of the sheet feeder if the connection determining unit determines that the sheet feeder is connected to the sheet feeder attaching unit. The sheet feeder stores the attribute information. The storage unit stores pieces of attribute information of sheet feeders which are compatible, in terms of control, with the image forming apparatus so that the pieces of attribute information are associated with identification information of the image forming apparatus. The compatibility determining unit determines as to whether or not the connected sheet feeder is compatible with the image forming apparatus by comparing the attribute information of the connected sheet feeder acquired by the acquiring unit with the pieces of attribute information of the sheet feeders stored in the storage unit. The forcible unconnected control unit establishes a forcible unconnected state between the connected sheet feeder and the image forming apparatus if the compatibility determining unit determines that the connected sheet feeder is not compatible with the image forming apparatus.

BRIEF DESCRIPTION OF THE DRAWINGS

Exemplary embodiments of the invention will be described in detail below based on the accompanying drawings, wherein:

FIG. 5 shows an example compatibility setting information management table;

FIG. 7A shows an example connection management table;

FIG. 7B shows a compatibility management table;

DETAILED DESCRIPTION

Figure 1:
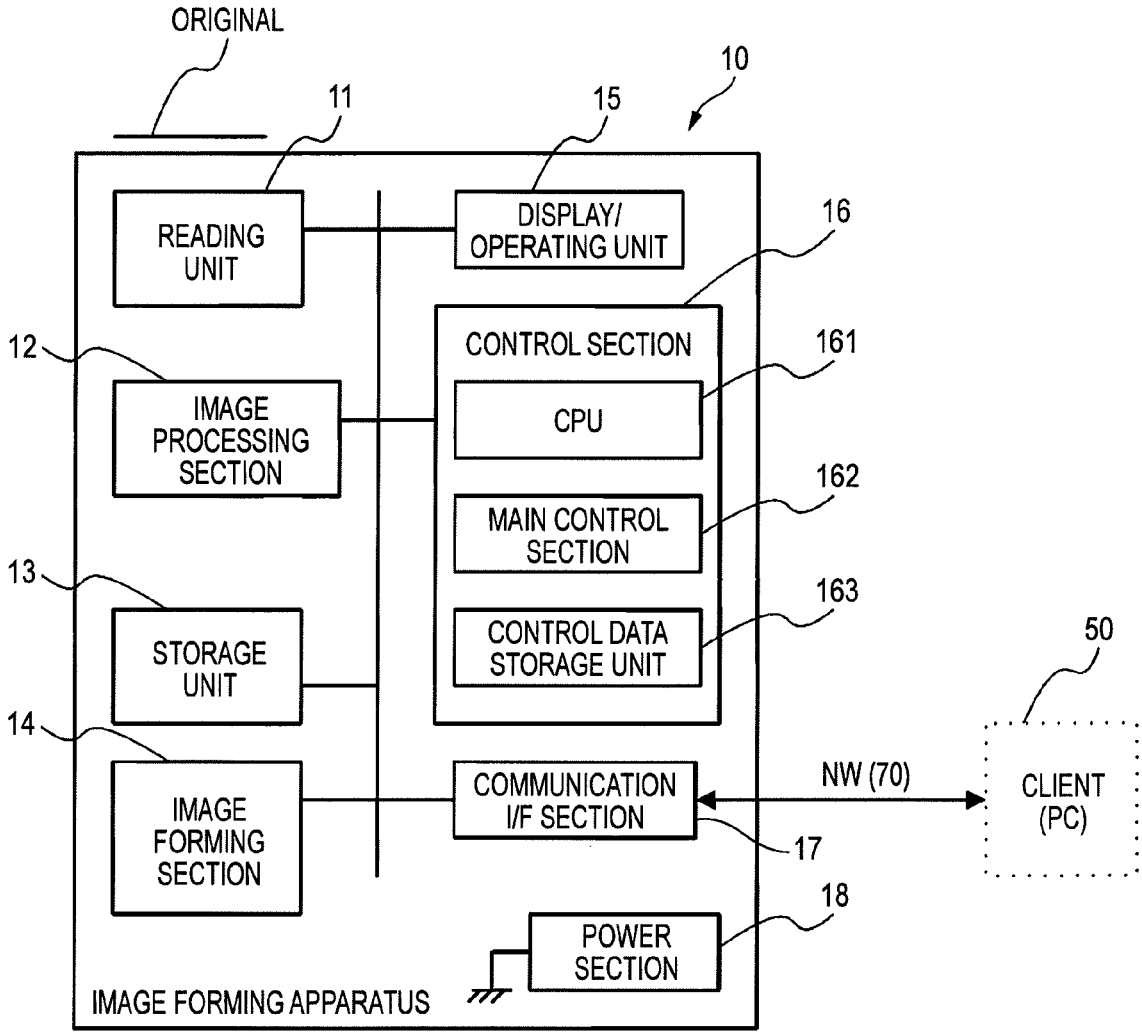
FIG. 1 is a block diagram showing the functional configuration of an image forming apparatus according to an exemplary embodiment of the present invention.

FIG. 1 is a block diagram showing the functional configuration of an image forming apparatus 10 according to an exemplary embodiment of the present invention.

The image forming apparatus 10 is a multifunction machine having plural functions such as document reading (scanning), copying, printing, and facsimile. The image forming apparatus 10 is equipped with a reading unit 11, an image processing section 12, a storage unit 13, an image forming section 14, a display/operating unit 15, a control section 16, a communication interface (I/F) section 17, and a power section 18. The reading unit 11 converts an image of a document (paper document) into an electrical image signal (image data) by scanning it. The image processing section 12 performs image processing to generate print data based on the read image data (scan data) obtained by scanning the document with the reading unit 11 or a print job that is transmitted from a client terminal (personal computer (PC)) 50. The storage unit 13 stores various kinds of information such as scan data and operation programs. The image forming section 14 forms an image corresponding to the print data generated by the image processing section 12 on a recording medium (recording sheet; which hereinafter which will be referred to as a "sheet") by executing an electrophotographic process based on the print data. The display/operating unit 15 includes a display unit such as a liquid crystal display device and an operating unit having various operating keys such as a ten-key unit. The control section 16 controls the entire apparatus 10, for example, controls the operations of individual units/sections relating to each function such as scanning, copying, printing, or facsimile. The communication interface section 17 performs communication interfacing in communicating with such an apparatus as the client terminal 50 over a transmission line (communication network (NW)) F70. The power section 18 can turn on or off the power and supplies power that is necessary for operation to the individual units/sections of the apparatus main body while the power is on.

The control section 16 includes a CPU (central processing unit) 161, a main control section 162, and a control data storage unit 163. The main control section 162 is one of modules to be supervised and controlled by the CPU 161 and has a function of performing a print control according to a print job and functions specific to the exemplary embodiment, that is, (i) a function of determining as to whether or not a sheet feed tray (sheet feeder) is physically connected and (ii) a function of determining as to whether or not a sheet feed tray is compatible. The control data storage unit 163 stores various control data to be used for sheet-feeder connection determination and compatibility determination, such as a connection status flag and a compatibility flag (see FIGS. 7A and 7B; which will be described later).

Figure 2:
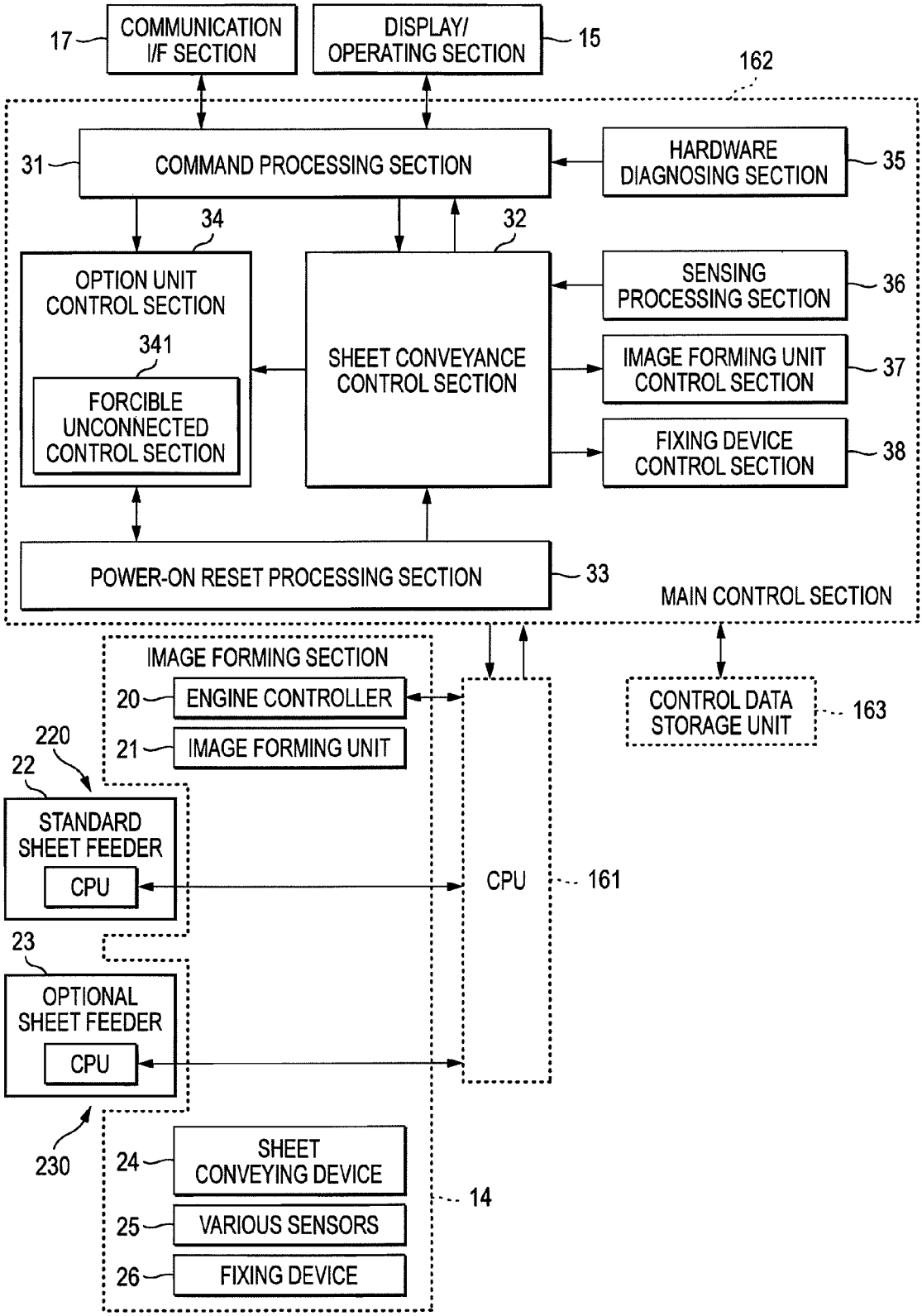
FIG. 2 is a block diagram showing a detailed functional configuration of a main part of the image forming apparatus of FIG. 1.

FIG. 2 is a block diagram showing a detailed functional configuration of the main part of the image forming apparatus 10 of FIG. 1.

As shown in FIG. 2, the image forming apparatus 10 is equipped with hardware elements of the image forming section 14 etc. The hardware elements, which are to be controlled by the main control section 162, include an image forming unit 21, a standard sheet feeder attaching unit 220, an optional sheet feeder attaching unit 230, a sheet conveying device 24, various sensors 25, and a fixing device 26. The image forming unit 21 has image forming modules of respective colors (yellow (Y), magenta (M), cyan (C), and black (K)). The standard sheet feeder attaching unit 220 has a structure to which a sheet feeder of a standard specification (standard sheet feeder, standard sheet feed tray) 22 can be detachably attached. The optional sheet feeder attaching unit 230 has a structure to which an optional sheet feeder (i.e., an additional sheet feeder that is prepared for function extension in addition to the standard sheet feeder 22) 23 can be detachably attached. The sheet conveying device 24 conveys, to a discharge tray (not shown) via the image forming modules of the respective colors. Each sheet is fed out from the standard sheet feeder 22 being attached (connected) to the standard sheet feeder attaching unit 220 or the optional sheet feeder 23 being attached (connected) to the optional sheet feeder attaching unit 230. The various sensors 25 include a sensor for detecting passage of a sheet being conveyed by the sheet conveying device 24. The fixing device 26 heat-fuses, on a sheet, toner images of the respective colors which have been developed by the image forming modules of the respective colors and transferred to the sheet in superimposition.

An engine controller 20, which accompanies the above hardware elements, exchanges control information with individual control modules (which will be described later) provided in the main control section 162 via the CPU 161 of the control section 16 and thereby controls individual processes of exposure, development, and transfer in the image forming modules (print engines) of the respective colors and such operations as the feeding-out and conveyance of a sheet according to a transfer timing and the fusing of an image transferred to a sheet by the fixing device 26.

The main control section 162 of the image forming apparatus 10 is equipped, as the above-mentioned control modules, with a command processing section 31, a sheet conveyance control section 32, a power-on reset processing section 33, an optional unit control section 34, a hardware diagnosing section 35, a sensing processing section 36, an image forming unit control section 37, and a fixing device control section 38. The command processing section 31 executes a command, such as a print job, that is supplied from the client terminal 50 via the communication I/F section 17 (or supplied from the display/operating unit 15 when it is operated). The sheet conveyance control section 32 performs a sheet conveyance control by driving the sheet conveying device 24. The power-on reset processing section 33 initializes (resets) the individual modules when the image forming apparatus (apparatus main body) 10 is powered on. The optional unit control section 34 controls an optional sheet feeder 23 attached to the optional sheet feeder attaching unit 230, for example, determines as to whether or not an optional sheet feeder 23 is connected to the optional sheet feeder attaching unit 230, determines as to whether or not a connected optional sheet feeder 23 is compatible with the apparatus main body 10, and controls a timing of sheet fed from a compatible optional sheet feeder 23. The hardware diagnosing section 35 diagnoses hardware operation states. The sensing processing section 36 detects (senses) a sheet jam etc. by taking in detection outputs of the various sensors 25. The image forming unit control section 37 drive-controls the image forming modules of the respective colors, which constitute the image forming unit 21. The fixing device control section 38 controls a fusing operation of the fixing device 26.

Figure 3A:
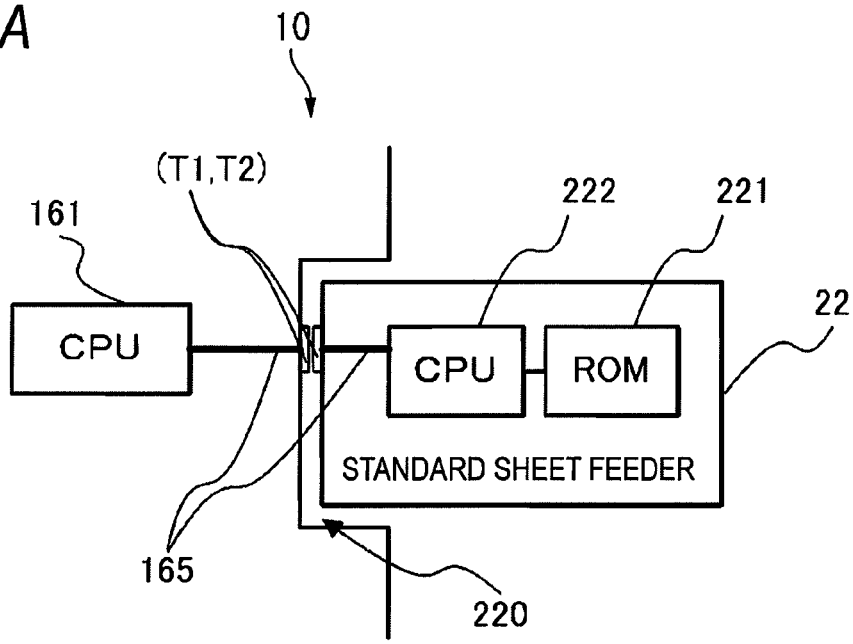
FIGS. 3A and 3B are conceptual diagrams showing manners of attachment of a standard sheet feeder and an optional sheet feeder to the image forming apparatus and their functional configurations.
Figure 3B:
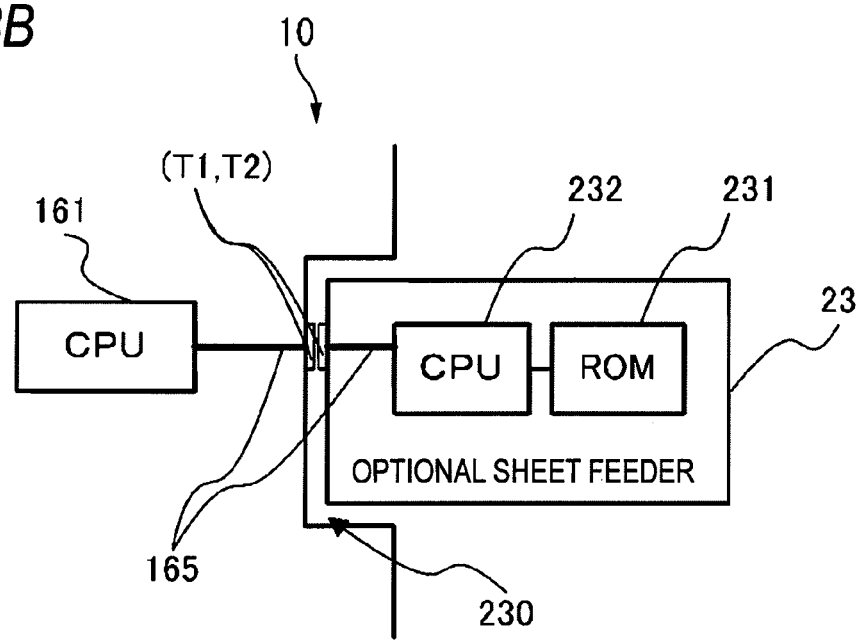

FIGS. 3A and 3B are conceptual diagrams showing manners of attachment of the standard sheet feeder 22 and an optional sheet feeder 23 to the image forming apparatus 10 and their functional configurations.

As shown in FIG. 3A, the standard sheet feeder 22 is equipped with a ROM (read-only memory) 221 and a CPU 222. The ROM 221 stores a particular operation control program such as a standard sheet feed control program for controlling an operation of feeding a sheet from the standard sheet feeder 22. The CPU 222 controls the sheet feed from the standard sheet feeder 22 according to the standard sheet feed control program. In a state where the standard sheet feeder 22 is attached to the apparatus main body 10 as shown in FIG. 3A, terminals T1 and T2 are connected to each other, whereby the CPU 222 can communicate with the CPU 161 of the control section 16 of the apparatus main body 10 over a transmission channel 165 (e.g., a serial communication such as RS232C).

Likewise, as shown in FIG. 3B, the optional sheet feeder 23 which can be detachably attached to the optional sheet feeder attaching unit 230 is equipped with a ROM 231 and a CPU 232. The ROM 231 stores a particular operation control program such as an optional sheet feed control program for controlling an operation of feeding sheet from the optional sheet feeder 23. The CPU 232 controls the sheet feed from the optional sheet feeder 23 according to the optional sheet feed control program. In a state where the optional sheet feeder 23 is attached to the apparatus main body 10 as shown in FIG. 3B, terminals T1 and T2 are connected to each other, whereby the CPU 232 can communicate with the CPU 161 of the apparatus main body 10 over the transmission channel 165.

That is, the CPU 161 of the control section 16 and the CPU 232 of the optional sheet feeder 23 have communication functions of communicating with each other.

The communication function of the CPU 161 executes a connection-determination communication procedure a connection-determination communication procedure of attempting to make a communication for sending a connection check request signal to the CPU 232 of the optional sheet feeder 23 via the optional sheet feeder attaching unit 230 when the apparatus main body 10 is powered on (or with prescribed timing after power-on) and determines as to whether or not the optional sheet feeder 23 is connected based on whether or not a response to the connection check request signal is received (i.e., whether or not a communication can be established). The communication function of the CPU 161 also executes a compatibility-determination communication procedure of acquiring, as compatibility-determination control information, attribute information (e.g., version information (update information) of the optional sheet feed control program stored in the ROM 231) indicating an attribute of the optional sheet feeder 23 from the optional sheet feeder 23 and determining as to whether or not the optional sheet feeder 23 is compatible with the apparatus main body 10 in terms of control (i.e., whether or not they match each other so as to enable a normal sheet feed operation control) based on the acquired compatibility-determination control information (the attribute information of the optional sheet feeder 23).

That is, in the exemplary embodiment, the connection determination and the compatibility determination for the optional sheet feeder are perform by using firmware rather than a mechanical structure such as a switch.

Incidentally, with the configuration (see FIG. 3B) of the optional sheet feeder attaching unit 230 of the image forming apparatus 10 according to the exemplary embodiment, it goes without saying that an optional sheet feeder 23 that is compatible with the apparatus main body 10 can be attached to the attachment/detachment mechanism of the optional sheet feeder attaching unit 230. There may also be a case where the attachment/detachment mechanism of the optional sheet feeder attaching unit 230 can accept, as an optional sheet feeder, a sheet feeder which is not compatible with the apparatus main body 10 (its operation is undesirable) and which is to be accepted by another apparatus main body as a standard sheet feeder.

In such a case, the connection (attachment) of the accepted incompatible optional sheet feeder 23 is unstable. If the connection continues to be recognized, sheet feed may be started with the connection being kept unstable when a print job is received, to cause an erroneous operation.

The exemplary embodiment is provided with a countermeasure against such an event (i.e., a countermeasure for preventing an unstable operation that may occur when a sheet feeder whose operation is undesirable (i.e., a sheet feeder that is not compatible with the apparatus main body 10) is attached). The image forming apparatus 10 is provided with the following function which is implemented as a forcible unconnected control section 341 (see FIG. 2). When an incompatible optional sheet feeder 23 happens to be attached to the optional sheet feeder attaching unit 230, whether or not the optional sheet feeder 23 is compatible with the apparatus main body 10 is determined based on the compatibility-determination control information (the attribute information of the optional sheet feeder 23) that is acquired from the optional sheet feeder 23 by the serial communication. If it is determined that the optional sheet feeder 23 is not compatible, a control is performed so as to establish a forcible unconnected state between the apparatus main body 10 and the incompatible optional sheet feeder 23 being connected to the optional sheet feeder attaching unit 230.

To realize this forcible unconnected control function, each optional sheet feeder 23 that is involved in the exemplary embodiment holds, as the compatibility-determination control information, version information (update information (ROM version information)) of the sheet feed control program, which is stored in the ROM 231.

Figure 4A:
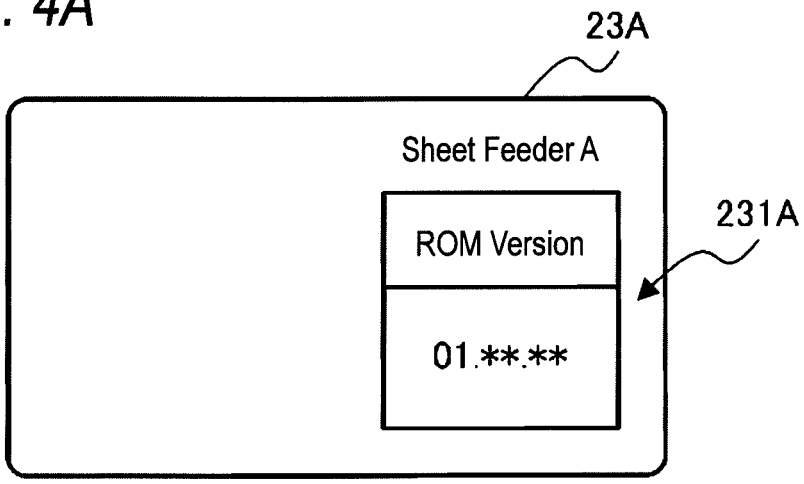
FIGS. 4A and 4B are conceptual diagrams showing information storage forms of optional sheet feeders.
Figure 4B:
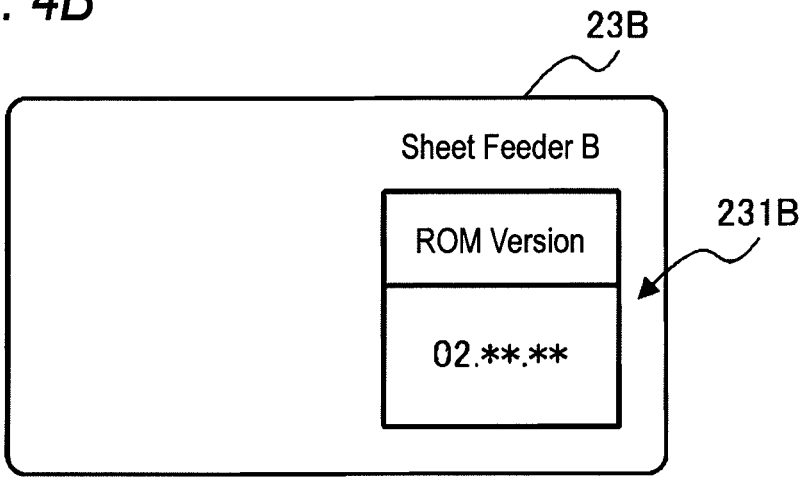

FIGS. 4A and 4B are conceptual diagrams showing information storage forms of optional sheet feeders 23 which are used for the image forming apparatus 10 according to the exemplary embodiment.

As shown in FIGS. 4A and 4B, in an optional sheet feeder 23A (sheet feeder A) and an optional sheet feeder 23B (sheet feeder B), their ROMs 231A and 231B store, as pieces of compatibility-determination control information, pieces of version information (ROM version information) indicating versions "01.." and "02.." of the sheet feed control programs stored therein, respectively.

On the other hand, in the control section 16 of the apparatus main body 10, the control data storage unit 163 stores a compatibility setting information management table 1633 which contains, for example, compatibility setting information as shown in FIG. 5.

The compatibility setting information management table 1633 contains (i) unique identification information (IDs) of image forming apparatuses (apparatus main bodies A, B, C, . . . ) according to the exemplary embodiment which are connected to the same network 70 and (ii) information which prescribe compatibility between the image forming apparatuses (the apparatus main bodies A, B, C, . . . ) and optional sheet feed control programs (version information) stored in the ROMs 231 of optional sheet feeders 23 (sheet feeders A, B, C, . . . ) that can be detachably attached to the optional sheet feeder attaching units 230 of the apparatus main bodies A, B, C, . . . .

In the example of FIG. 5, as for the relationships between the apparatus main bodies A, B, C, . . . and the optional sheet feed control programs (version information) of the sheet feeders A, B, C, . . . a value "1" means compatible, and a value "0" means incompatible.

The compatibility setting information management table 1633 of FIG. 5 holds the pieces of attribute information (ROM version information) of the optional sheet feeders 23 which are compatible with the respective apparatus main bodies 10 in such a manner that the attribute information are associated with the IDs of the apparatus main bodies 10. However, the compatibility setting information management table 1633 may hold pieces of attribute information of optional sheet feeders 23 that are compatible with one apparatus main body 10 in such a manner that the attribute information are associated with the ID of the one apparatus main body 10.

The presence of the compatibility setting information management table 1633 shown in FIG. 5 enables the following operations. When the optional sheet feeder 23A (sheet feeder A) shown in FIG. 4A which holds the ROM version information "01.." is attached to an apparatus main body 10 (assumed to be the apparatus main body A), the main control section 161 (forcible unconnected control section 341) can determine that the sheet feeder A is compatible with the apparatus main body A itself by acquiring the ROM version information "01.." from the ROM 231 of the attached sheet feeder A via the CPU 161 and reading the compatibility setting value "1" as a compatibility determination result from the compatibility setting information management table 1633 using the ROM version information "01.." and the ID of "1000" of the apparatus main body A itself.

On the other hand, when the optional sheet feeder 23B (sheet feeder B) shown in FIG. 4B which holds the ROM version information "02.." is attached to the apparatus main body A, the main control section 161 (forcible unconnected control section 341) can determine that the sheet feeder B is not compatible with the apparatus main body A itself by acquiring the ROM version information "02.." from the ROM 231 of the attached sheet feeder B via the CPU 161 and reading the compatibility setting value "0" as a compatibility determination result from the compatibility setting information management table 1633 using the ROM version information "02.." and the ID "1000" of the apparatus main body A itself.

If the attached sheet feeder B is determined incompatible with the apparatus main body A itself, the forcible unconnected control section 341 notifies the engine controller 20 of establishment of a forcible unconnected state.

The engine controller 20 has a function of controlling the image forming unit 21, the sheet conveying device 24, etc. so as to prohibit a sheet from being fed when the optional sheet feeder attaching unit 230 of the apparatus main body 10 is designated as a sheet feed source but when the unconnected state is established between the apparatus main body 10 and an optional sheet feeder 23 that can be connected to the optional sheet feeder attaching unit 230 of the apparatus main body 10.

As a result, when receiving a forcible unconnected state notice, the engine controller 20 performs a control so that no sheet is fed from the incompatible optional sheet feeder B.

The forcible unconnected control section 341 stores a result of determination as to whether or not an optional sheet feeder 23 is connected to the optional sheet feeder attaching unit 230 and a result of determination as to whether or not the optional sheet feeder 23 is compatible with the apparatus main body 10 (in the case where the optional sheet feeder 23 is connected) in a connection management table 1634 (see FIG. 7A) and a compatibility management table 1635 (see FIG. 7B), respectively, which are provided in the control data storage unit 163, for example. When a print job is received later, the engine controller 20 performs an operation control for feeding a sheet or prohibiting a sheet from being fed or a display control for displaying a message to the effect that the optional sheet feeder 23 is incompatible or a message that urges replacement with a compatible optional sheet feeder 23 based on the connection determination result and the compatibility determination result, which are held in the connection management table 1634 and the compatibility management table 1635, respectively.

Next, a control process for making an incompatible optional sheet feeder in a forcible unconnected state which is executed in the image forming apparatus 10 according to the exemplary embodiment will be described with reference to a flowchart of FIG. 6.

Figure 6:
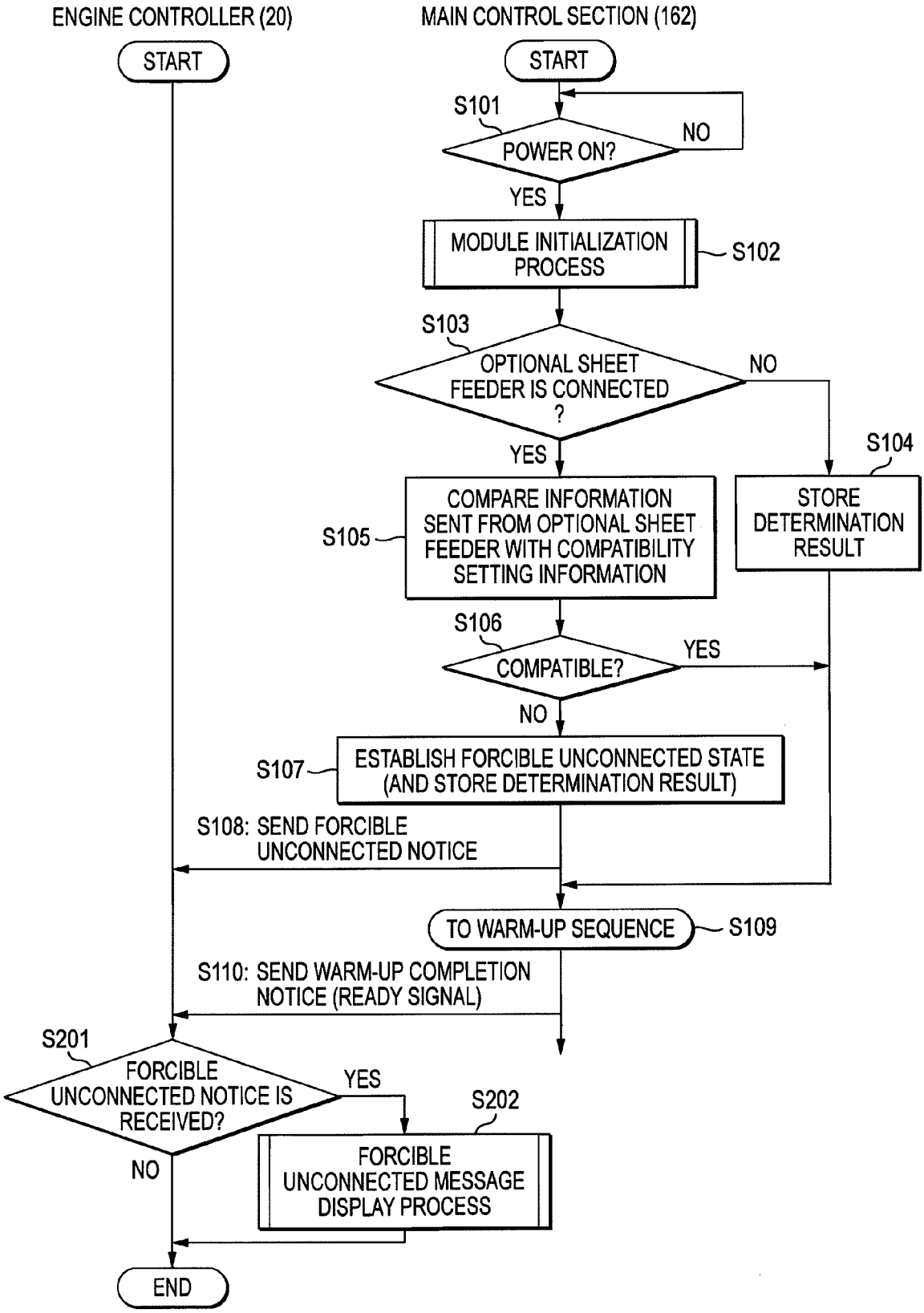
FIG. 6 is a flowchart of a control process for making an incompatible optional sheet feeder in a forcible unconnected state.

As shown in FIG. 6, at step S101, if the power of the image forming apparatus 10 is off, the main control section 162 monitors as to whether or not the image forming apparatus 10 has been powered on.

If the image forming apparatus 10 has been powered on S101 (yes), at step S102 the power-on reset processing section 33 starts a process of resetting the modules such as the sheet conveyance control section 32 and the optional unit control section 34 (module initialization process).

If the step of initializing the optional unit control section 34 has been completed in the module initialization process of step S102, the forcible unconnected control section 341 of the optional unit control section 34 starts a connection check step.

In the connection check step, the forcible unconnected control section 341 executes the connection-determination communication procedure for an optional sheet feeder 23 via the CPU 161 and the optional sheet feeder attaching unit 230 (specifically, the forcible unconnected control section 341 causes the CPU 161 to send a connection check request signal to the CPU 232 of the optional sheet feeder 23) and monitors as to whether or not a response to the connection check request signal is received.

A response signal to the connection check request signal is received if an optional sheet feeder 23 is attached to the optional sheet feeder attaching unit 230 (a transmission channel 165 is established between the CPU 232 and the apparatus main body 10). However, if no optional sheet feeder 23 is attached to the optional sheet feeder attaching unit 230 (no transmission channel 165 is established between the CPU 232 and the apparatus main body 10), no response signal to the connection check request signal is received.

If the response signal is sent from the CPU 232 of the optional sheet feeder 23 attached to the optional sheet feeder attaching unit 230 in response to the connection check request signal in the connection-determination communication procedure, the forcible unconnected control section 341 can determined at step S103 that the optional sheet feeder 23 is attached (connected). If no optional sheet feeder 23 is connected to the optional sheet feeder attaching unit 230 and hence no response signal is received in response to the connection check request signal, the forcible unconnected control section 341 can determine at step S103 that no optional sheet feeder 23 is attached (connected).

If determining, after the transition to the connection-determination communication procedure, that no optional sheet feeder 23 is connected (step S103: no), at step S104 the forcible unconnected control section 341 stores the determination result. And, the process proceeds to step S109 (warm-up step) where the individual sections/units are caused to operate until becoming operative.

At step S104 (connection determination result storing step), the forcible unconnected control section 341 sets a flag in the connection management table 1634 (see FIG. 7A) that indicates a state of physical connection of an optional sheet feeder 23 to the optional sheet feeder attaching unit 230 to a value "0" which means that physical connection is not established.

On the other hand, if determining, after the transition to the connection-determination communication procedure, that an optional sheet feeder 23 is connected (step S103: yes), the forcible unconnected control section 341 sets a physical connection status flag in the connection management table 1634 to a value "1" which means that physical connection is established. Then, the forcible unconnected control section 341 executes the compatibility-determination communication procedure with the CPU 232 of the optional sheet feeder 23, which is connected to the optional sheet feeder attaching unit 230.

In the compatibility-determination communication procedure, at step S105 the forcible unconnected control section 341 acquires the version information (ROM version information) of the optional sheet feed control program, which is stored in the ROM 231 of the optional sheet feeder 23 attached to the optional sheet feeder attaching unit 230, and compares the acquired ROM version information (the information transmitted from the optional sheet feeder 23) with the compatibility setting information stored in the compatibility setting information management table 1633 (see FIG. 5). At step S106, the forcible unconnected control section 341 determines, based on a comparison result, as to whether or not the connected optional sheet feeder 23 is compatible with the apparatus main body 10.

If determining that the attached optional sheet feeder 23 is compatible with the apparatus main body 10 (S106: yes), the forcible unconnected control section 341 sets, for example, a flag in the compatibility management table 1635 of FIG. 7B that indicates compatibility (software connectivity) of the optional sheet feeder 23 with the apparatus main body 10 to the value "1" which means compatible (connectible in terms of software). Then, the process proceeds to step S109 for warming up the individual sections/units.

On the other hand, if determining that the attached optional sheet feeder 23 is not compatible with the apparatus main body 10 (S106: no), at step S107 the forcible unconnected control section 341 performs a control so as to establish a forcible unconnected state between the attached optional sheet feeder 23 and the apparatus main body 10.

More specifically, for example, the forcible unconnected control section 341 sets the compatibility flag in the compatibility management table 1635 of FIG. 7B to the value "0" which means incompatible.

Upon execution of step S107, at step S108 the forcible unconnected control section 341 notifies the engine controller 20 that the forcible unconnected state has been established. Then, the process proceeds to step S109 (warm-up step).

At step S109, the individual modules for which the reset processing by the power-on reset processing section 33 has completed execute respective warm-up sequences under the control of the main control section 162. Upon completion of the warm-up sequences of the individual modules, at step S110 the optional unit control section 34 notifies a signal (ready signal) indicating completion of the warm-up processing to the engine controller 20. As a result, a transition is made to a state (standby state) in which a print job can be accepted.

On the other hand, when receiving the forcible unconnected notice, which are sent from the main control section 162 at step S108, after power-on of the image forming apparatus 10, the engine controller 20 stores and holds the content (establishment of the forcible unconnected state) of the received notice as notification state information.

When receiving the warm-up completion notice from the main control section 162, at step S201 the engine controller 20 determines, by referring to the stored notification state information, as to whether or not it has been notified of establishment of a forcible unconnected state.

If the engine controller 20 determines that it has not been notified of establishment of a forcible unconnected state (S201: no), the process is terminated (i.e., a transition is made to a standby state).

On the other hand, if determining that it has been notified of establishment of a forcible unconnected state (S201: yes), at step S202 the engine controller 20 instructs the display/operating unit 15 to display, on the display unit 155, a message to the effect that the forcible unconnected state is established. Then, the process is terminated.

After making the transition to the standby state through execution of the step of determining physical connection of an optional sheet feeder 23 to the optional sheet feeder attaching unit 230 (step S103) and the compatibility (software connectivity) determination step (step S106) of the process of FIG. 6, the image forming apparatus 10 receives a print job and performs a printing operation.

Figure 8:
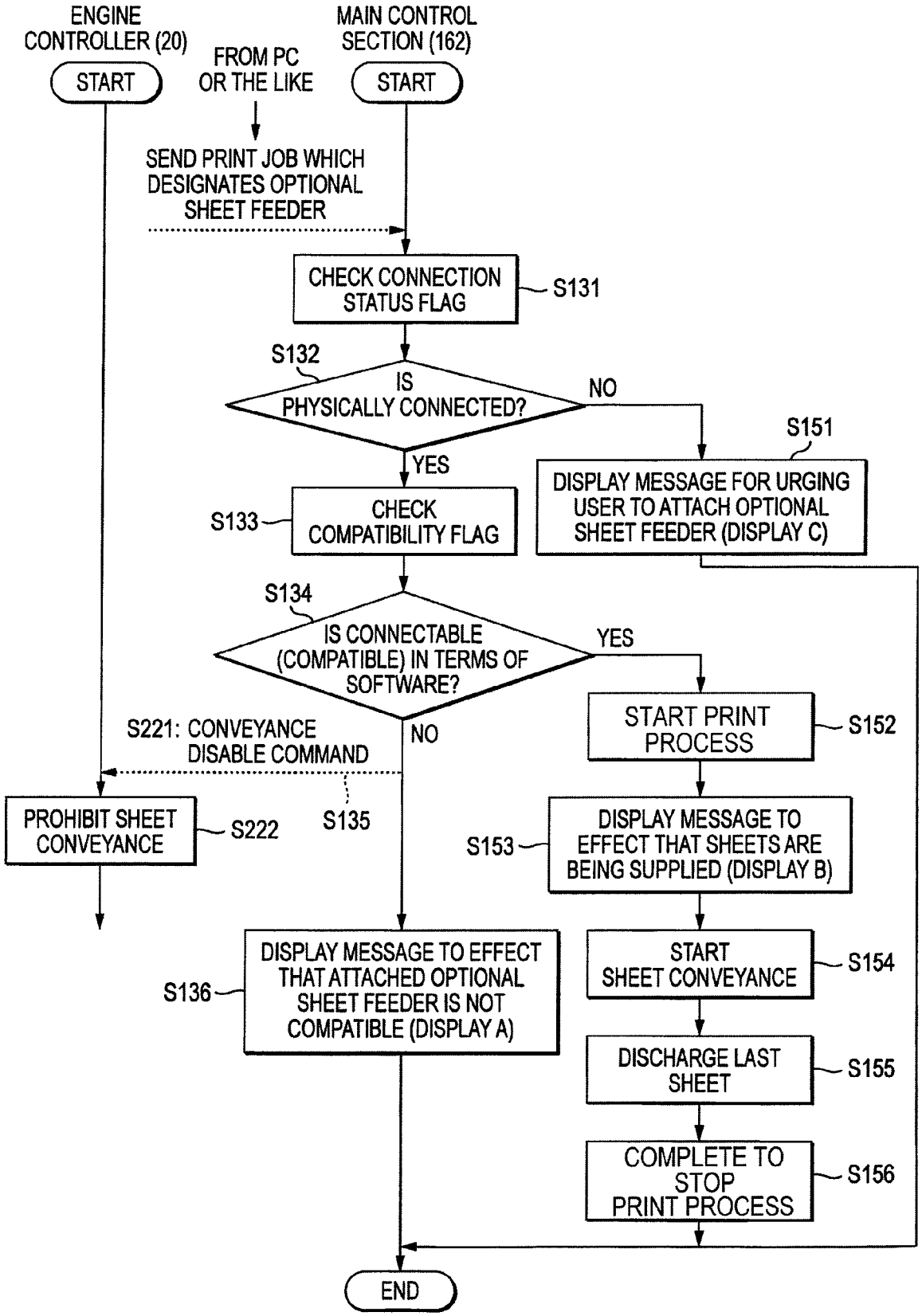
FIG. 8 is a flowchart of a print control process which is executed by the image forming apparatus.

FIG. 8 is a flowchart of a print control process which is executed by the image forming apparatus 10.

Referring to FIG. 8, if a print job that designates an optional sheet feeder 23 is received from the client terminal 50, for example, at step S131 the main control section 162 checks the connection status flag in the connection management table 1634 (see FIG. 7A). At step S132, the main control section 162 determines as to whether or not the optional sheet feeder 23 is physically connected to the optional sheet feeder attaching unit 230.

If determining that the optional sheet feeder 23 is not connected (step S132: no) because the connection status flag in the connection management table 1634 that corresponds to the optional sheet feeder attaching unit 230 concerned is "0," at step S151 the main control section 162 displays, on the display unit 155 of the display/operating unit 15, a message (see LCD display C shown in FIG. 12) for urging a user to attach an optional sheet feeder 23 that is compatible with the apparatus main body 10 to the optional sheet feeder attaching unit 230. Then, the process returns to a standby state.

On the other hand, if determining that the optional sheet feeder 23 is connected (step S132: yes) because the connection status flag in the connection management table 1634 which corresponds to the optional sheet feeder attaching unit 230 concerned is "1," at step S133 the main control section 162 checks the compatibility flag in the compatibility management table 1635 (see FIG. 7B). At step S134, the main control section 162 determines as to whether or not the optional sheet feeder 23 connected to the optional sheet feeder attaching unit 230 is compatible with the apparatus main body 10.

If determining that the optional sheet feeder 23 is not compatible because the compatibility flag in the compatibility management table 1635 which corresponds to the optional sheet feeder attaching unit 230 concerned is "0" (step S134: no), at step S135 the main control section 162 sends a conveyance disable command to the engine controller 20.

When receiving the conveyance disable command at step S221, at step S222 the engine controller 20 disables image formation by instructing the image forming unit 21 to do so and disables the sheet feed from the incompatible, attached optional sheet feeder 23 by instructing the sheet conveying device 24 etc. to do so.

After sending the conveyance disable command, at step S136 the main control section 162 displays, on the display unit 155, a message (LCD display A shown in FIG. 11) to the effect that an incompatible optional sheet feeder 23 is attached to the optional sheet feeder attaching unit 230 (the user is urged to attach a compatible optional sheet feeder 23). Then, the process returns to a standby state.

If determining that the optional sheet feeder 23 is compatible because the compatibility flag in the compatibility management table 1635 which corresponds to the optional sheet feeder attaching unit 230 concerned is "1" (step S134: yes), at step S152 the main control section 162 instructs the image forming modules of the respective colors to start a print process.

At step S153, the main control section 162 displays, on the display unit 155, a message (see LCD display B shown in FIG. 11) to the effect that the compatible optional sheet feeder 23, which is attached to the optional sheet feeder attaching unit 230, is feeding sheets. At step S154, the main control section 162 causes the optional sheet feeder 23 to feed and convey sheets in such a manner that the sheet conveyance is synchronized with execution of image forming processes from the first page to the last page.

When detecting that image formation for the last page has completed and the sheet on which an image of the last page is formed has been discharged at step S155, the main control section 162 stops the print process. Then, the process returns to a standby state.

In the exemplary embodiment, as shown in FIG. 6, in a post-power-on period from the completion of initialization of the individual functional sections to the start of their warm-up (in this period, the processing load is lighter than that in, for example, a period before the start of a sheet feed operation), the optional unit control section 34 (forcible unconnected control section 341) causes the CPU 161 to execute the connection-determination communication procedure, that is, send the connection check request signal to the optional sheet feeder attaching unit 230 and monitors a response. If determining that an optional sheet feeder 23 is physically connected because a response to the connection check request signal has been received, the optional unit control section 34 acquires ROM version information from the optional sheet feeder 23 and determines as to whether or not the optional sheet feeder 23 is compatible with the apparatus main body 10 by executing the compatibility-determination communication procedure. If determining that the optional sheet feeder 23 is not compatible, the optional unit control section 34 performs the control so as to establish a forcible unconnected state between the optional sheet feeder 23 and the apparatus main body 10 (steps S107 and S108 shown in FIG. 6).

With the above controls, sheet feed from an incompatible optional sheet feeder 23 which is narrowly attached to the optional sheet feeder attaching unit 230 (with play) is prohibited, whereby an unstable printing operation can be avoided.

An optional sheet feeder 23 for another type of apparatus main body which is not compatible with the apparatus main body 10 can be detected mainly by firmware without using any mechanism such as a switch. This makes it possible to lower the entire development cost and to reduce the risk of an erroneous operation.

In the exemplary embodiment, when a print job is received, a display control is performed according to a connection state of an attached optional sheet feeder 23 and a determination result of its compatibility (steps S136, S151, and S153 shown in FIG. 8). This makes it possible to enhance the operability and reliability of attachment of a compatible optional sheet feeder 23, replacement of an incompatible optional sheet feeder 23 with a compatible one, etc. which are carried out by the user.

Next, specific example display controls which are performed according to determination results of a connection state and compatibility of an optional sheet feeder 23 will be described in detail with reference to FIGS. 9 to 12.

FIGS. 9 to 12 assume an application in a network configuration in which plural client terminals such as client A (50A) and client B (50B) and plural printer main bodies such as an image forming apparatus 10A (printer main body A) and an image forming apparatus 10B (printer main body B) are connected to each other via a network 70.

Each of the printer main bodies A and B is equipped with a standard sheet feeder attaching unit 220 (tray 1) and an optional sheet feeder attaching unit 230 (tray 2). Although each of the printer main bodies A and B can be configured so as to be equipped with plural optional sheet feeder attaching units 230 (tray 2, tray 3, etc.), for the sake of simplicity, the following description will be directed to a simple case where each of the printer main bodies A and B is equipped with a single optional sheet feeder attaching unit 230.

It is also assumed that each of the printer main bodies A and B has a functional configuration with which an automatic sheet feeder switching can be set selectively. The automatic sheet feeder switching is a function that if no sheet remains in the standard sheet feeder 22 (set at the tray 1 position) that is designated by a print job, sheets are fed from another sheet feeder (optional sheet feeder 23) containing sheets.

Figure 9:
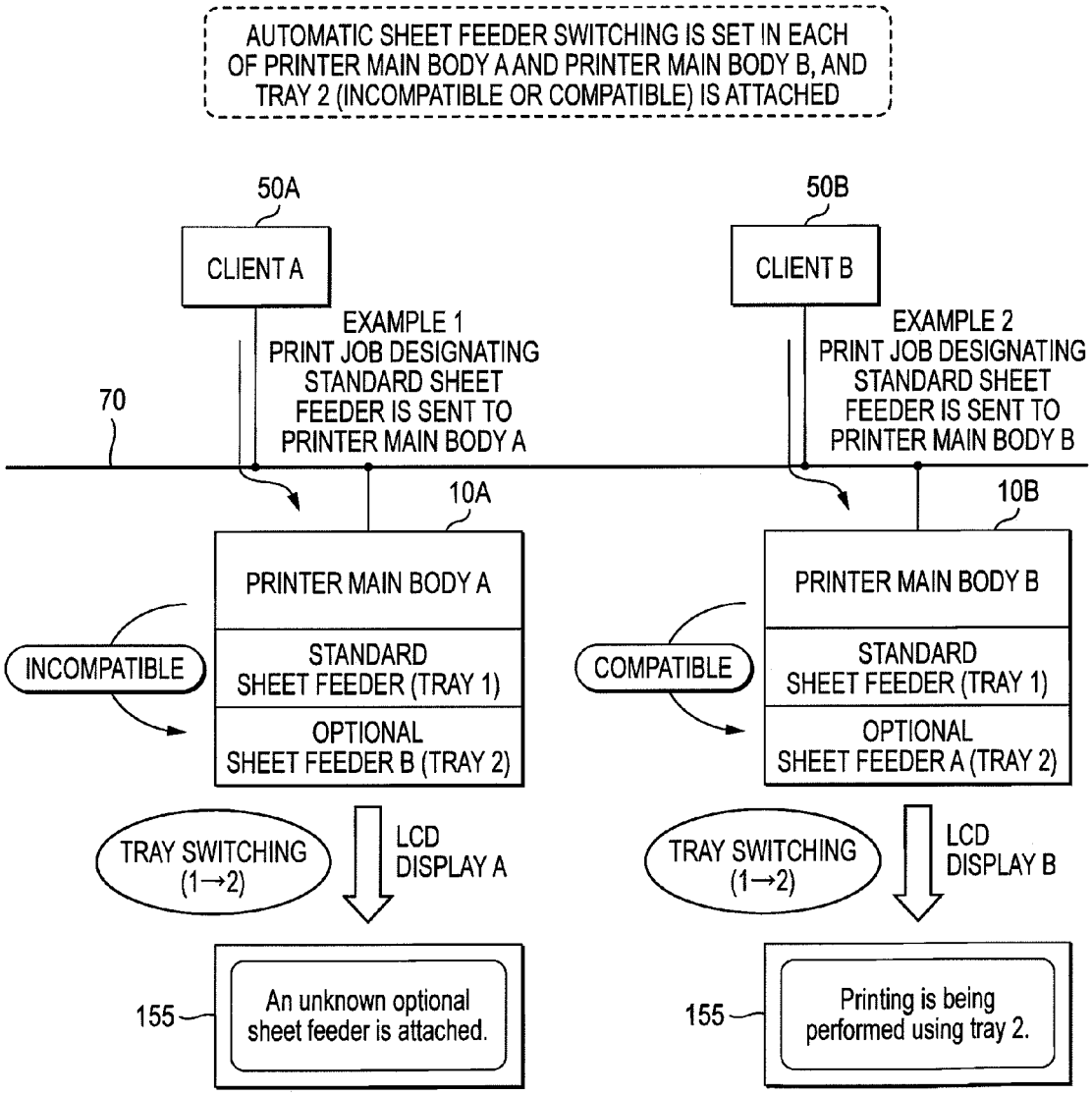
FIG. 9 shows first and second example operations in which automatic sheet feeder switching is set and an incompatible or compatible optional sheet feeder is connected.
Figure 10:
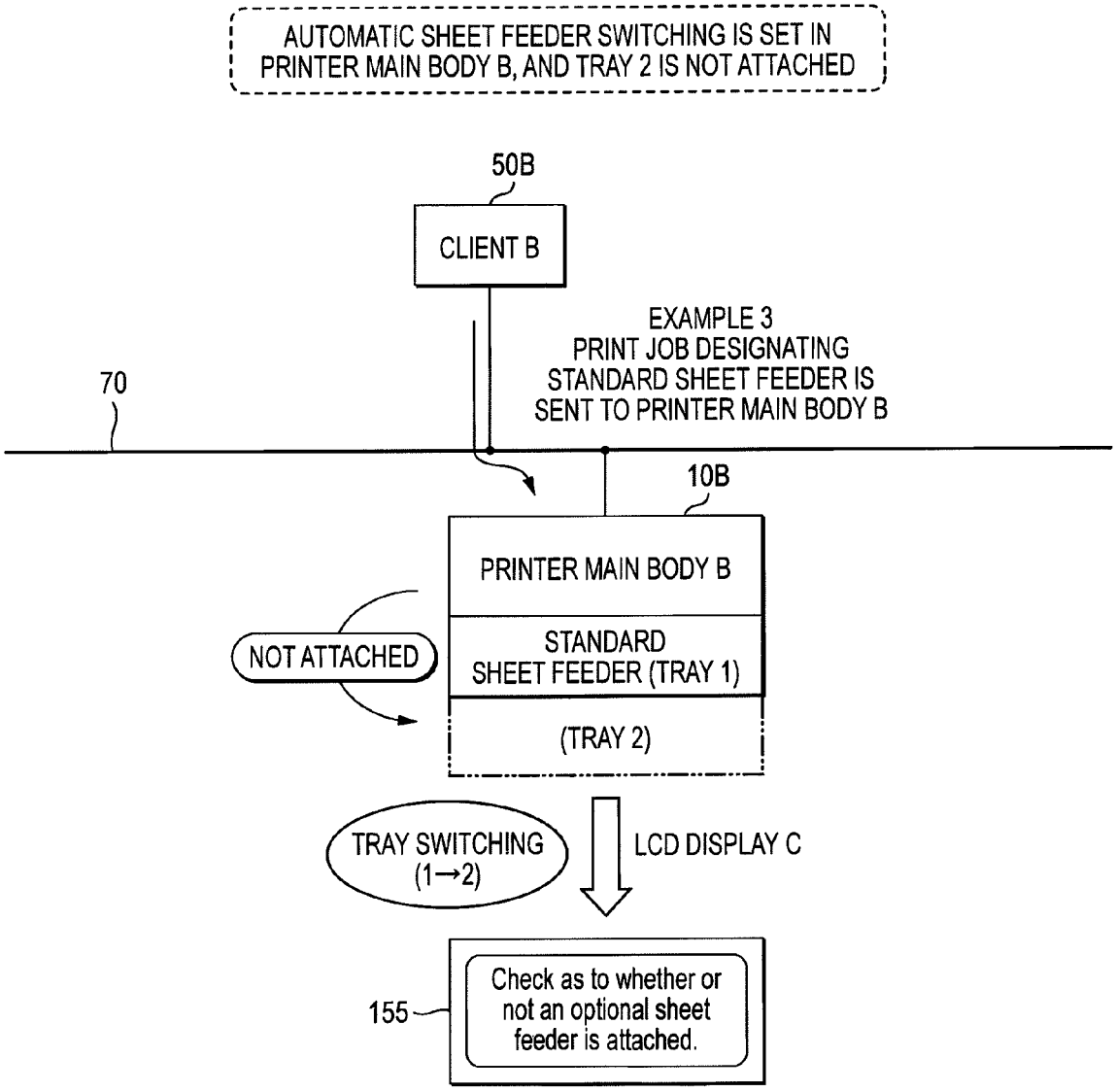
FIG. 10 shows a third example operation in which the automatic sheet feeder switching is set and no optional sheet feeder is connected.

FIGS. 9 and 10 show examples 1 to 3 in which the automatic sheet feeder switching is set in both of the printer main bodies A and B and each of the printer main bodies A and B receives a print job that designates the standard sheet feeder.

In the example 1 shown in FIG. 9, an optional sheet feeder (sheet feeder B) which is not compatible with the printer main body A is attached to the printer main body A. In the example 2 shown in FIG. 9, an optional sheet feeder (sheet feeder A) which is compatible with the printer main body B is attached to the printer main body B. In the example 3 shown in FIG. 10, neither the standard sheet feeder nor an optional sheet feeder is attached to the printer main body B.

With the above assumptions, as shown in the example 1 of FIG. 9, when a print job that designates the standard sheet feeder is sent from the client terminal 50A to the printer main body A, switching is made from tray 1 to tray 2 if no sheet remains in the standard sheet feeder because the automatic sheet feeder switching is set.

Since the optional sheet feeder B (switching destination) which is set at the tray 2 position is determined incompatible, a message (display A) "An unknown optional sheet feeder is attached." is displayed on the display unit 155 of the display/operating unit 15 as an example message to the effect that an incompatible optional sheet feeder is set at the tray 2 position (i.e., a message for urging the user to attach a compatible sheet feeder).

As shown in the example 2 of FIG. 9, when the print job, which designates the standard sheet feeder, is sent from the client terminal 50B to the printer main body B, switching is made from the tray 1 to the tray 2 if no sheet remains in the standard sheet feeder because the automatic sheet feeder switching is set.

Since the optional sheet feeder A (switching destination) which is set at the tray 2 position is determined compatible, a message (display B) "Printing is being performed using the tray 2." is displayed on the display unit 155 as an example message indicating an operation that is being performed with a compatible optional sheet feeder set at the tray 2 position.

As shown in FIG. 10, when a print job that designates the standard sheet feeder is sent from the client terminal 50B to the printer main body B, switching is made from the tray 1 to the tray 2 if no sheet remains in the standard sheet feeder because the automatic sheet feeder switching is set.

Since it is determined that no sheet feeder is set (connected) at the tray 2 position (switching destination position), a message (display C) "Check whether or not an optional sheet feeder is attached." is displayed on the display unit 155 as a message for urging the user to set a compatible optional sheet feeder at the tray 2 position.

Figure 11:
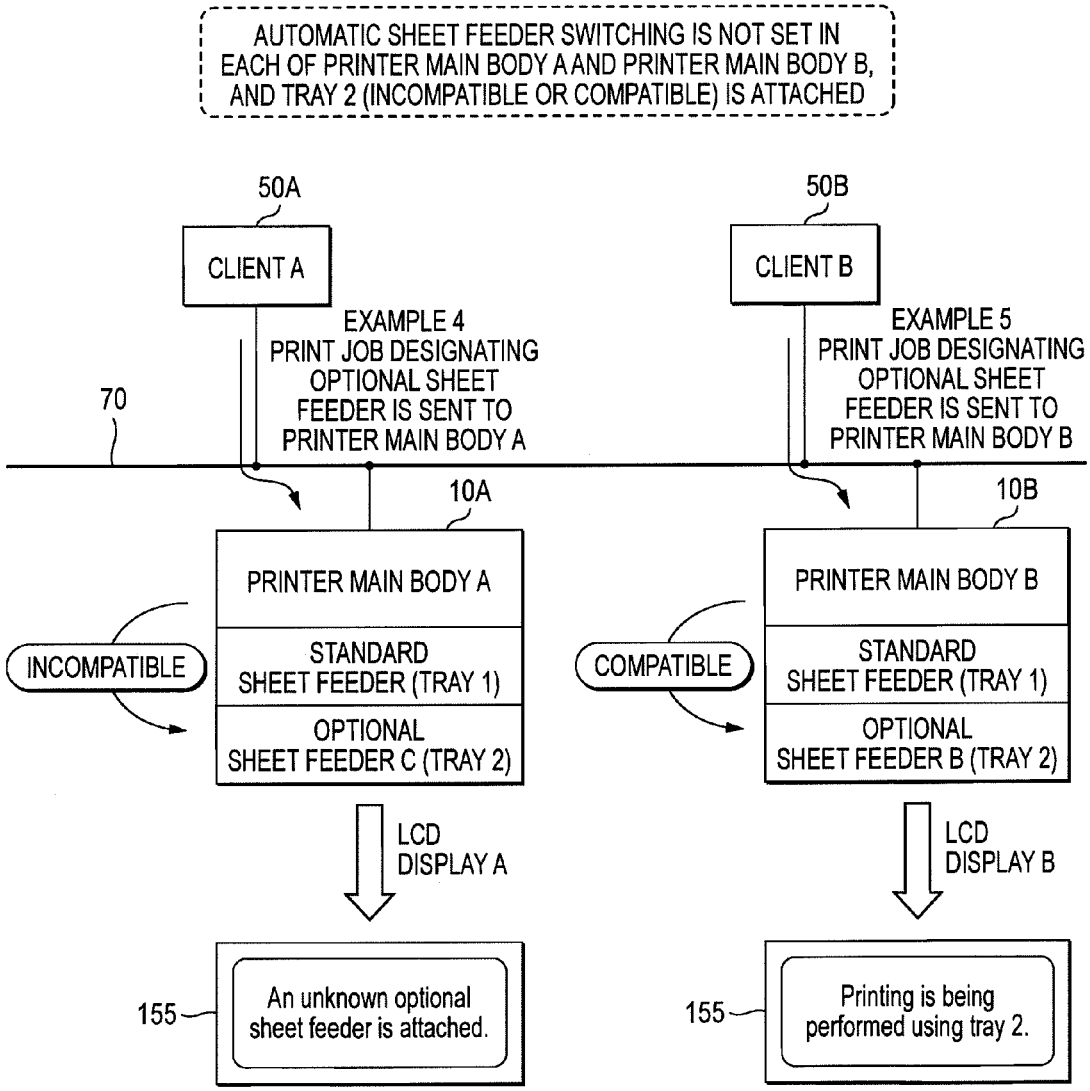
FIG. 11 shows fourth and fifth example operations in which the automatic sheet feeder switching is not set and an incompatible or compatible optional sheet feeder is connected.
Figure 12:
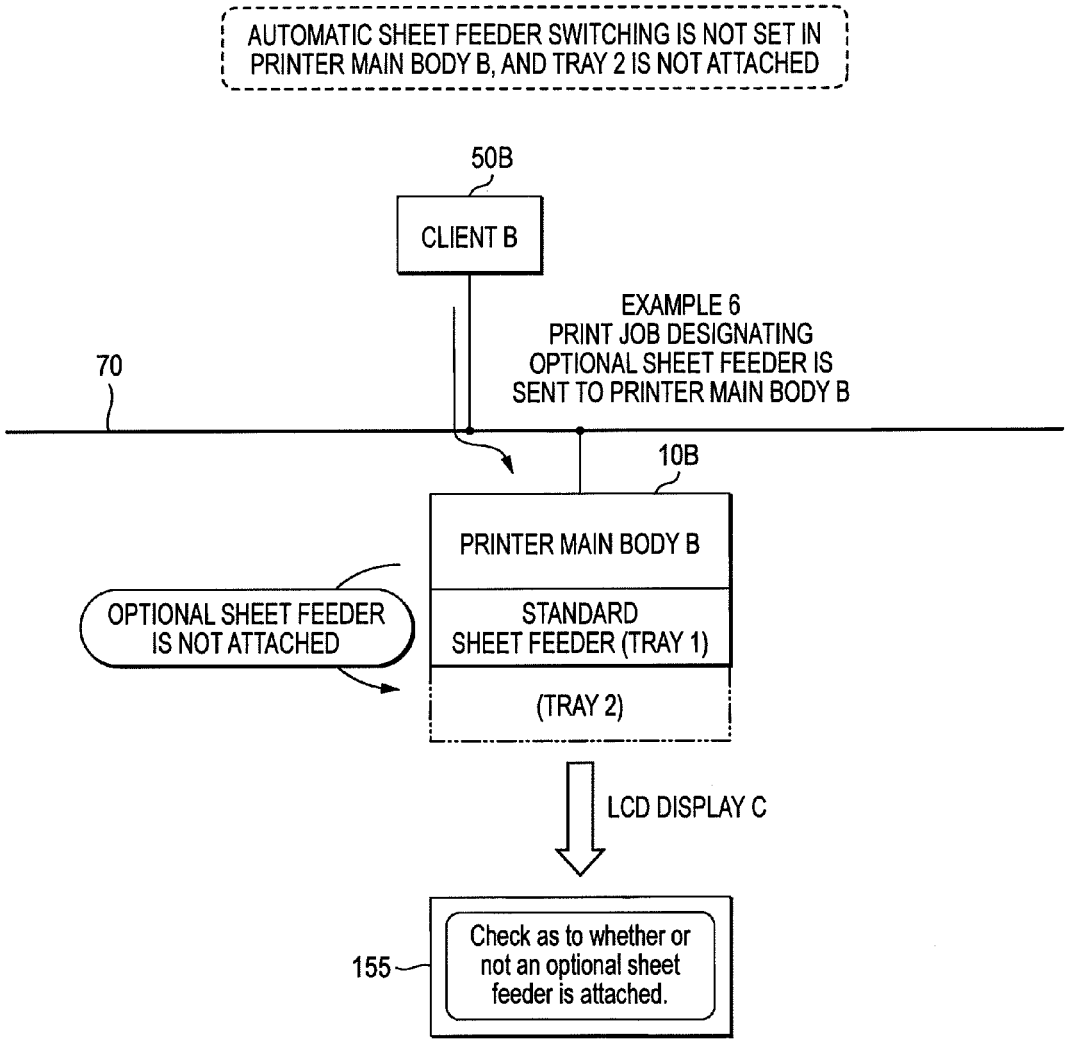
FIG. 12 shows a sixth example operation in which the automatic sheet feeder switching is not set and no optional sheet feeder is connected.

FIGS. 11 and 12 show examples 4 to 6 in which the automatic sheet feeder switching is set in neither of the printer main bodies A nor B and each of the printer main bodies A and B receives a print job that designates an optional sheet feeder.

In the example 4 shown in FIG. 11, an optional sheet feeder (sheet feeder C) which is not compatible with the printer main body A is attached to the printer main body A. In the example 5 shown in FIG. 11, an optional sheet feeder (sheet feeder B) which is compatible with the printer main body B is attached to the printer main body B. In the example 6 shown in FIG. 12, neither the standard sheet feeder nor an optional sheet feeder is attached to the printer main body B.

With the above assumptions, as shown in the example 4 of FIG. 11, when the print job, which designates an optional sheet feeder, is sent from the client terminal 50A to the printer main body A, since the optional sheet feeder C which is attached to the optional sheet feeder attaching unit (set at the tray 2 position) is determined incompatible, the message (display A) "An unknown optional sheet feeder is attached." is displayed on the display unit 155 as an example message to the effect that an incompatible optional sheet feeder is set at the tray 2 position (i.e., a message for urging the user to attach a compatible sheet feeder).

As shown in the example 5 of FIG. 11, when the print job, which designates an optional sheet feeder set at the tray 2 position, is sent from the client terminal 50B to the printer main body B, since the optional sheet feeder A (switching destination) which is set at the tray 2 position is determined compatible, the message (display B) "Printing is being performed using tray 2." is displayed on the display unit 155 as an example message indicating an operation that is being performed with a compatible optional sheet feeder set at the tray 2 position.

As shown in the example 6 of FIG. 12, when the print job, which designates an optional sheet feeder, is sent from the client terminal 50B to the printer main body B, since it is determined that no sheet feeder is attached to the optional sheet feeder attaching unit (set at the tray 2 position), the message (display C) "Check whether or not an optional sheet feeder is attached." is displayed on the display unit 155 as a message for urging the user to set a compatible optional sheet feeder at the tray 2 position.

The invention is not limited to the exemplary embodiments that have been described above and illustrated with reference to the drawings, and various modifications can be made as appropriate without departing from the spirit and scope of the invention.

In the above embodiment, pieces of attribute information of sheet feeders that are compatible, in control, with an apparatus main body are held so as to be correlated with IDs of respective apparatus main bodies and whether or not a sheet feeder connected to a sheet feeder attaching unit is compatible with the apparatus main body is determined by comparing attribute information of the connected sheet feeder acquired from the connected sheet feeder with the pieces of attribute information, held in advance so as to be correlated with the IDs of the respective apparatus main bodies, of the sheet feeders that are compatible, in control, with the respective apparatus main bodies. For example, a modification is possible in which whether or not a sheet feeder connected to a sheet feeder attaching unit is compatible with the apparatus main body is determined by comparing attribute information of the connected sheet feeder acquired from the connected sheet feeder with pieces of attribute information, held in advance, of sheet feeders that are compatible, in control, with the apparatus main body.

Although the above embodiment is such that the invention is applied to the multifunction machine, the invention can also be applied to various image forming apparatus such as a printer which is equipped with one or plural sheet feeder attaching units and a mechanism for feeding sheets from each of sheet feeders attached to the respective sheet feeder attaching units.

In the above exemplary embodiment, a sheet feeder-compatibility determination processing program is installed in a computer which performs functions of an image forming apparatus which forms an image on a sheet while causing a sheet feeder attached to a sheet feeder attaching unit to supply the sheet and the sheet feeder-compatibility determination processing program causes the computer to function as connection determining unit for determining as to whether or not a sheet feeder is connected to a sheet feeder attaching unit based on a result of a communication that has been attempted by communication unit; compatibility determining unit for determining as to whether or not the sheet feeder connected to the sheet feeder attaching unit is compatible with the apparatus main body by comparing attribute information of the connected sheet feeder acquired by acquiring unit with pieces of attribute information of sheet feeders that are compatible, in control, with apparatus main bodies, the pieces of attribute information of the sheet feeders being held by holding unit so as to be correlated with pieces of identification information of the respective apparatus main bodies; forcible unconnected control unit for performing a control so as to establish a forcible unconnected state between the connected sheet feeder and the apparatus main body if the compatibility determining unit determines that the connected sheet feeder is not compatible with the apparatus main body; and other means. A modification is possible in which the sheet feeder-compatibility determination processing program is provided being stored in a storage medium such as a CD-ROM.

The invention can be applied to an image forming apparatus such as a multifunction machine and a sheet feeder-compatibility determination processing program which prevent an erroneous operation by establishing a forcible unconnected state in the case where a sheet feeder attached to a sheet feeder attaching unit is not compatible with the apparatus main body.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The exemplary embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. An image forming apparatus comprising:

a sheet feeder attaching unit;

a communication unit;

a storage unit that stores information relating to sheet feeders configured to be attached to the sheet feeder attaching unit; and a processor configured to implement:

a connection determining unit, wherein when the image forming apparatus is powered on, the connection determining unit causes the communication unit to make a connection confirmation request through the sheet feeder attaching unit, the connection determining unit determines a connection state between a processor of a sheet feeder and the processor of the image forming apparatus, based on whether a response signal to the connection confirmation request is received from the processor of the sheet feeder, and when receiving no response signal, the connection determining unit determines that connection is not established between the sheet feeder and the sheet feeder attaching unit, when receiving the response signal, the connection determining unit determines that connection is established between the sheet feeder and the sheet feeder attaching unit, and the connection determining unit stores a result of the determination in the storage unit;

a compatibility determining unit, wherein when the connection determining unit determines that the connection is established, the compatibility determining unit determines whether the connected sheet feeder is compatible with the image forming apparatus based on program version information of the sheet feeder, and when determining that the connected sheet feeder connected to the sheet feeder attaching unit is not compatible with the image forming apparatus, the compatibility determining unit stores information indicating incompatibility in the storage unit; and a connection controller, wherein when the storage unit stores the information indicating incompatibility between the connected sheet feeder and the image forming apparatus, the connection controller forcibly controls the connection state between the connected sheet feeder and the image forming apparatus to be disconnected.

* * * * *